United States Patent [19]

McMillen et al.

[11] 4,339,048

[45] Jul. 13, 1982

[54] GARBAGE BAG HOLDER

[76] Inventors: Bruce A. McMillen; Beverly A. Cortier, both of 26013 U.S. 20, South Bend, Ind. 46628

[21] Appl. No.: 178,699

[22] Filed: Aug. 18, 1980

[51] Int. Cl.[3] ..... B65D 25/24; B65D 6/08

[52] U.S. Cl. ..... 220/18; 220/19; 220/69; 220/331; 211/71; 248/153

[58] Field of Search ..... 220/6, 7, 18, 19, 69, 220/331; 211/71; 248/143, 146, 156

[56] References Cited

U.S. PATENT DOCUMENTS

| | | | |
|---|---|---|---|
| 797,871 | 8/1905 | Smith | 220/7 |
| 863,893 | 8/1907 | Allen | 220/8 |
| 3,119,619 | 1/1964 | Frank | 248/156 |
| 3,178,142 | 4/1965 | Koch | 248/146 |
| 3,279,733 | 10/1966 | Hannan | 248/153 |
| 3,494,478 | 2/1970 | Link | 211/71 |
| 3,934,728 | 12/1976 | Guth | 220/19 |

*Primary Examiner*—George E. Lowrance
*Attorney, Agent, or Firm*—Marmaduke A. Hobbs

[57] ABSTRACT

A garbage bag holder for minimizing the accessibility of garbage bags to neighborhood pets or other animals, in which the bags are held in a basket disposed on a pedestal. The pedestal may be mounted in, and removed from, a receptacle disposed in the ground, sidewalk, driveway, or the like and holds the basket in spaced relation to the ground. An openable wall provides an easy access through which the bags can be deposited and removed.

8 Claims, 7 Drawing Figures

Fig. 4
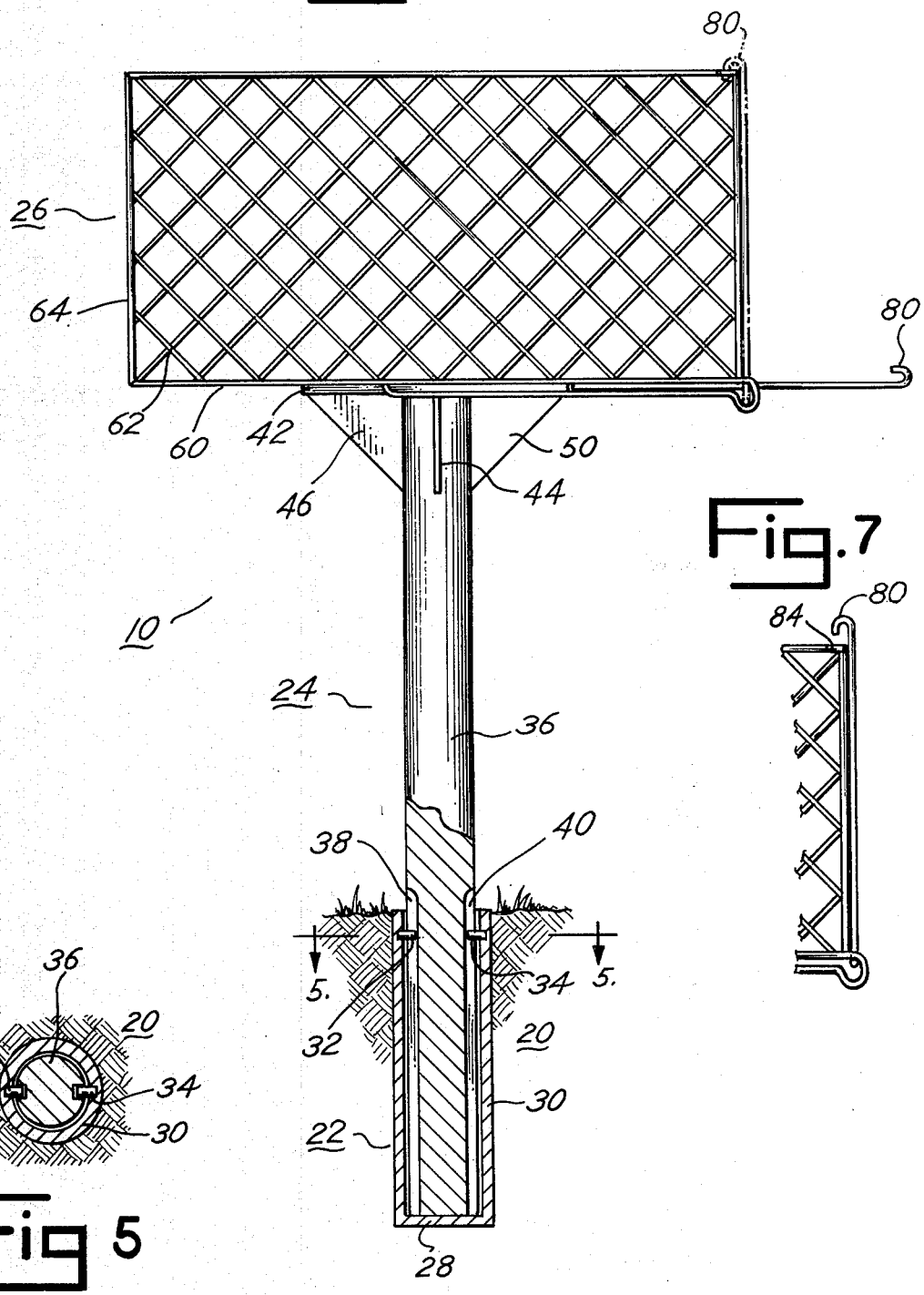
Fig. 7
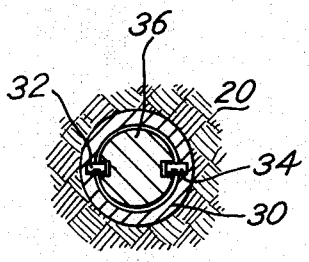
Fig 5

GARBAGE BAG HOLDER

The handling of garbage in a neat and sanitary manner has long presented problems for people, including those living in metropolitan areas who rely on professional garbage collectors to gather their refuse and haul it to proper disposal sites. The periodic collection relieves the individual of the problem of the final disposition of the garbage; however, he still must collect and store the garbage between the scheduled collection days, which normally requires garbage storage for about a week. In the past, covered garbage cans of plastic or metal were used to store the garbage between pickups, and the cans were placed near the street or roadway so that the garbage could be emptied therefrom into a collecting truck. One of the principal disadvantages in using garbage cans to store garbage is that the can quickly becomes dirty from the garbage, especially when food items or opened food containers are discarded from which liquids may seep. Hence, the exceptionally unpleasant task of scrubbing the inside of the garbage cans is required frequently, perhaps even weekly. A second disadvantage of using garbage cans to collect waste throughout the interval between pickups is that a person must have a sufficient number of cans to hold all of the garbage which will be collected. Hence, at times, a number of empty garbage cans must be stored, requiring a substantial amount of storage space. Further, metal garbage cans are easily dented, smashed or otherwise rendered unusable when being emptied into the truck, thus frequently requiring replacement at significant cost.

To overcome the aforementioned disadvantages in the use of garbage cans, many people are now using garbage can liners in addition to, or in place of garbage cans. The liners are relatively durable plastic bags into which garbage may be placed. When the bag is full, it is closed by tying the top, or by securing the top with twist tabs or the like. The bags may be used without cans, or may be used as liners in cans, in which case the mess created in the garbage can is substantially reduced, in that the liquids and dirt from the garbage will be sealed in the bag. If the garbage bags are used without cans, the problem of storing empty garbage cans is completely eliminated. Even if a garbage can is used with the liner therein to make the deposit of garbage into the bag easier, fewer garbage cans are needed than if the plastic bags were not used, in that when a bag is full it can be closed, removed from the can, and placed aside until the scheduled collection day, and the same can may be used to fill all bags. Hence, storing of the empty garbage cans is not required. On the scheduled collection day, the bags of garbage are placed at the appropriate place, and the workers throw the entire bag into the bin on the collecting truck. Since the cans are not emptied into the truck, or placed near the street, the potential for damage thereto is substantially reduced, and replacement of cans is required less frequently.

While overcoming many of the disadvantages in using garbage cans alone for collecting garbage, other disadvantages are associated with using plastic bags. Garbage collection normally is scheduled for a particular day, with the hour thereof somewhat variable, and the plastic bags often must be placed outside unprotected overnight or for extended periods of time during the day. Cats, dogs and other animals are often attracted to the garbage, and can easily tear open the bags with their teeth and claws. The garbage can be scattered, which in turn may attract more animals to further scatter the garbage. This problem can be reduced by leaving the bags in garbage cans, and placing the can with bag therein at the location for collection; however, the advantage of not having to store a number of garbage cans is lost, and the potential for damage to the cans, with the resultant requirement and expense for replacement, is increased. Further, even if cans are used with or without bags, large dogs or other animals can upset the cans and scatter the garbage therefrom. It is therefore one of the principal objects of the present invention to provide a garbage bag holder which can be placed at the appropriate location for garbage collection to hold the garbage bags to be collected, and which will substantially reduce the accessibility of the bags to dogs, cats and other animals which may be attracted to the garbage.

Another object of the present invention is to provide a garbage bag holder which is easily mounted and removed at the collecting location to minimize interference with the landscape by being present only when in use to hold bags, and which includes easy access for loading garbage bags and for removing garbage bags at the time of collection.

A further object of the present invention is to provide a garbage bag holder which may be used to hold cans as well as bags in an elevated position above the reach of average household pets, and which permits rain to flow therethrough rather than to accumulate around the bags or cans.

A still further object of the present invention is to provide a garbage bag holder which can be constructed in a variety of sizes for holding one or several bags of garbage, which is easily cleaned and maintained, and which can be installed in a variety of supporting media, including ground, concrete and asphalt.

Additional objects and advantages of the present invention will become apparent from the following detailed description and the accompanying drawings, wherein:

FIG. 4 is a side elevational view, in partial cross section, of the garbage bag holder showing more clearly the ground securing mechanism;

FIG. 5 is a cross sectional view of the garbage bag holder shown in FIG. 4, taken on line 5—5 of the latter figure; and FIG. 6 is a fragmentary view of the openable wall of the present garbage bag holder showing the wall in closed position.

Figure 1:
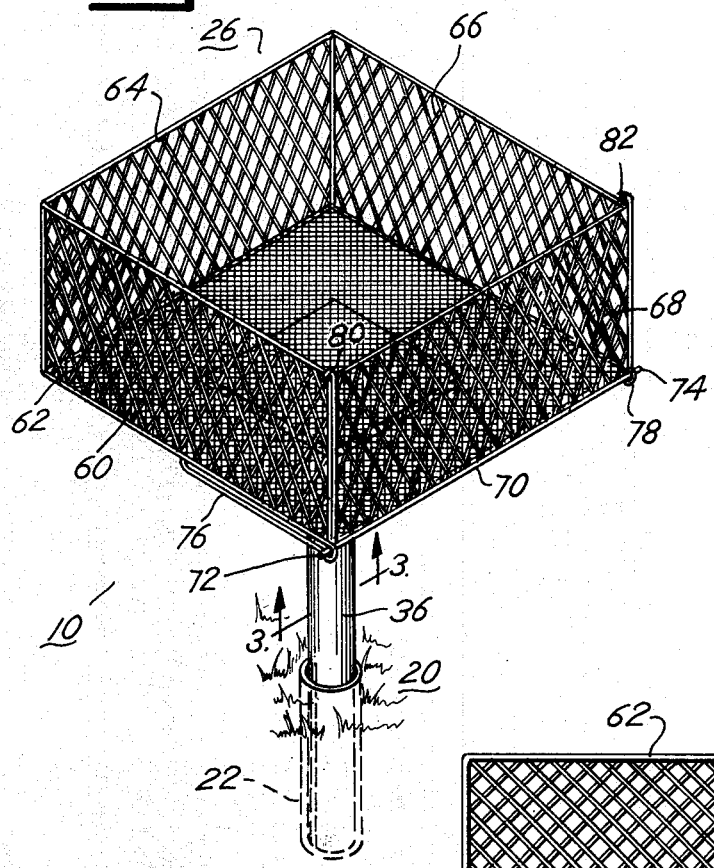
FIG. 1 is a perspective view of a garbage bag holder embodying the present invention.
Figure 2:
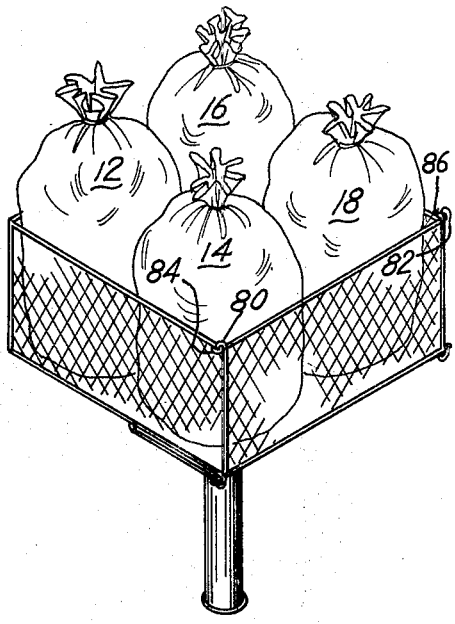
FIG. 2 is a perspective view showing the garbage bag holder with bags therein.
Figure 3:
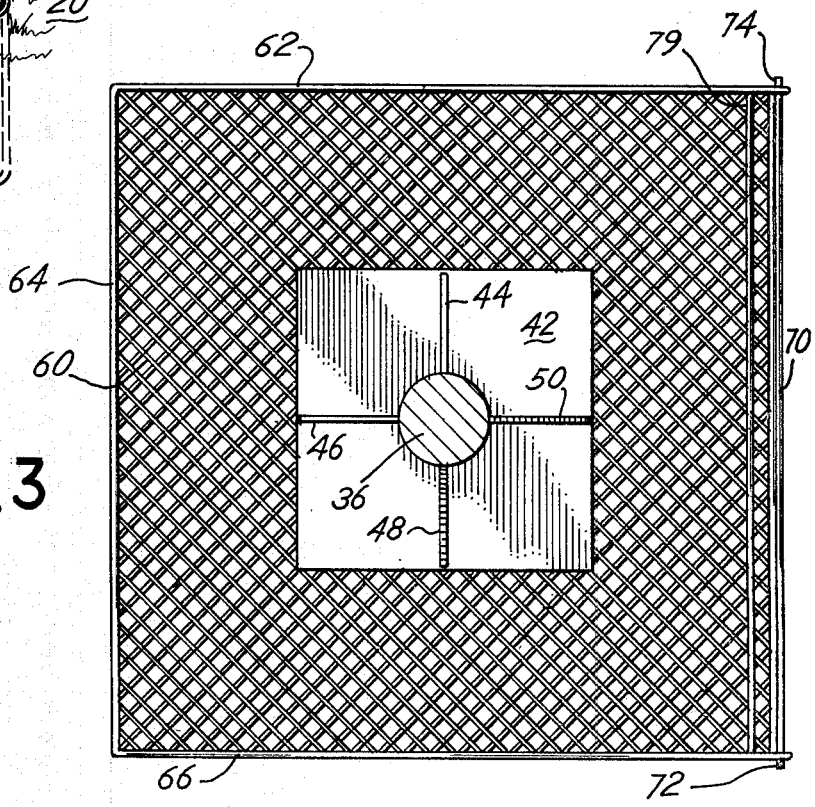
FIG. 3 is a cross sectional view of the garbage bag holder shown in FIG. 1, taken on line 3—3 of the latter figure.

Referring more specifically to the drawings, and to FIG. 1 in particular, numeral 10 designates a garbage bag holder embodying the present invention, which may be of a variety of sizes for holding different numbers of bags of different sizes. The embodiment shown in FIG. 2 is of a size for holding four average size garbage bags 12, 14, 16 and 18; however, smaller holders for one or two bags and larger holders for more or larger bags may also be made in accordance with the present invention. Although the garbage bag holder is shown mounted in a receptacle disposed in the ground 20, it should be understood that the receptacle of the present holder may also be disposed in other media, such as concrete or asphalt, as commonly found in sidewalks and driveways.

Garbage bag holder 10 includes a receptacle 22 disposed in the ground, a pedestal 24 extending upwardly therefrom, and a basket 26 on top of the pedestal. Receptacle 22 includes a bottom 28 and an upwardly extending side wall 30, and is disposed in the ground 20, or in other support medium, so that the upper edge of side wall 30 is substantially flush with the surface of the ground. Pins 32 and 34 extend inwardly from side wall 30, near the upper edge thereof. Pedestal 24 includes a stem 36 of slightly narrower diameter than the internal diameter of receptacle 22, for sliding into and out of the receptacle easily, without being excessively loose fitting when disposed therein. The stem has slots 38 and 40 extending from the bottom of the stem upwardly to a point slightly higher than the distance between bottom 28 and pins 32 and 34. Hence, as stem 36 is lowered into receptacle 22, pins 32 and 34 are received along slots 38 and 40, until the stem rests on bottom 28. A plate 42 is disposed on top of stem 36, for supporting basket 26, and reinforcement members 44, 46, 48 and 50 are connected between plate 42 and stem 36 to provide lateral support for the plate and basket. Receptacle 22 and pedestal 24 preferably are of metal; however, other suitable materials, including fiberglass and other rigid plastic compositions, may be used satisfactorily.

Basket 26 includes a bottom 60 with upwardly extending walls 62, 64, 66 and 68. An open-type construction is preferred for the bottom and side walls so that rain and snow will not accumulate in the basket, but instead will flow therethrough. Hence, mesh and expanded metal are appropriate materials for the bottom and walls. As previously mentioned, the size of basket 26 may vary, depending upon the number of bags and the size of bags to be retained therein; however, walls 62, 64, 66 and 68 should be of sufficient height to adequately retain the bags in the basket out of reach of animals and to prevent the bags from tipping out of the basket even if the holder is bumped or jarred severely. Thus, the walls will normally be at least about half the height of a filled garbage bag.

To make loading and unloading of the garbage bag holder easier, wall 68 may be unlatched from a vertical position, tilted to a substantially horizontal position, and slid partially under bottom 60, hence providing a side access to the basket. A rod 70 at the bottom of wall 68 has ends 72 and 74 which extend outwardly slightly past walls 62 and 66. Members 76 and 78 are disposed under walls 62 and 66, respectively, near the outer edge of bottom 60, and form channels into which ends 72 and 74 extend. A rod 79 is disposed under bottom 60 for holding wall 68 in a horizontal position after the wall has been opened. Hooks 80 and 82 at the top corners of wall 68 are connected to eyes 84 and 86 at the top corners of walls 62 and 66, respectively, to secure wall 68 in the closed position.

In the use and operation of a garbage bag holder embodying the present invention, a suitable location for the holder is selected, preferably near the site at which garbage is collected, such as along a driveway, road or street. A hole is dug and receptacle 22 is placed into the ground, sidewalk, driveway, or other support medium with the top of the receptacle substantially flush with the surface of the support medium. When garbage is to be placed out for collection, stem 36 of pedestal 24 is inserted into receptacle 22. Initially, the bottom of the stem may rest on top of pins 32 and 34, if slots 38 and 40 are not properly aligned with the pins; however, slight turning of the pedestal will align the slots with the pins. The pins are received along the slots as stem 36 is lowered into receptacle 22, until the bottom of the stem rests on bottom 28 of the receptacle. The pins in the slots permit only slight rotational movement of the stem in the receptacle; thus, the garbage bag holder is relatively solidly mounted in the receptacle. The garbage bags are placed into basket 26 by simply dropping them through the open top of the basket, or by opening wall 68 and sliding the bags through the opening. The wall is opened by lifting it slightly as shown in FIG. 6 to disengage hooks 80 and 82 from eyes 84 and 86. The wall is then lowered to a substantially horizontal position and slid rearwardly toward stem 36, thus placing the wall beneath the bottom of the basket in a substantially out of the way position. Rod 79 is beneath wall 68 when the wall is in its opened position, and holds the wall in a horizontal position. A portion of wall 68 extends outwardly from beneath bottom 60, as seen in FIG. 4, and may be used to support the garbage bags as the bags are being placed into basket 26. After the bags have been placed in the basket, wall 68 is pulled outwardly and raised so that hooks 80 and 82 will again engage with eyes 84 and 86, thereby holding the wall in the closed position. the garbage collectors can remove the bags either by pulling them out of the basket through the open top, or by opening wall 68 and pulling the bags through the opening.

With the bags being elevated above the ground, cats, dogs and other animals will be less attracted to the garbage in the bags, and will be less able to reach the bags. Hence, the animals will be prevented from tearing the bags open and spreading the garbage on the lawn. Even if animals approach the holder and attempt to reach the bags, it will be difficult, if not impossible, for the animals to tear open the bags which are protected by the basket walls. The bags will stay in the basket even if a large animal, such as a dog, stands with its front feet against the basket or bags, and the holder itself will remain in an upright position as long as stem 36 is disposed in receptacle 22. To remove the stem from the receptacle, a substantially vertical movement is required, and animals will not be able to perform such a movement. If the garbage bag holder is used when rain is falling, the water will flow through the basket and out the openings in the bottom and walls.

Stem 36 is easily inserted into, and removed from, receptacle 22; hence, the pedestal and retainer can be stored out of the way in a garage or the like, and placed near the street when garbage is placed out for collection. Thus, the garbage bag holder need not interfere with the appearance of a lawn and the surrounding landscape, except when necessary for the retention of garbage. A cap may be used to cover the opening of receptacle 22 when the pedestal is removed therefrom. Receptacles may be placed in several locations, as for example, along the roadside where the garbage truck will collect the garbage, and near, or in, a garbage. Thus, the garbage bag holder can be used to store garbage bags in an out of the way location during the periods between garbage collection, and can be moved to the collection site when the garbage is placed out for collection. The use and storage of garbage cans can be totally eliminated with the use of garbage bag holders embodying the present invention; however, the present invention may also be used for holding garbage cans, and will keep the cans out of easy reach by animals. When cans are held in the present holder, it is difficult for even large dogs to tip the cans over, in that the walls of the basket extend upwardly along the sides of the cans, holding them in an upright position. Cleaning of the garbage bag holder is easy, in that the holder may be sprayed periodically with water from a garden hose to dislodge dirt in the basket. The basket will dry quickly, in that the open construction of the walls and bottom permits the water to flow out of the basket and air to pass therethrough.

Although one embodiment of a garbage bag holder has been shown and described in detail herein, various changes may be made without departing from the scope of the present invention.

I claim:

1. A garbage bag holder for minimizing accessibility to garbage bags by animals, comprising four side walls forming a rectangularly shaped basket for holding the bags to prevent them from tipping out of said basket, a perforated bottom on which the bags are placed, one of said side walls being pivoted to said bottom for swinging downwardly to open the respective side and provide free access to the basket, means joining the other three side walls to form a rigid structure, a pedestal disposed under said bottom of said basket for supporting said basket in spaced relation to the ground, and means having a vertical opening for releasably holding said pedestal in an upright position with the basket spaced above the ground.

2. A garbage bag holder as defined in claim 1 in which said pedestal includes a stem, a plate on top of said stem supporting said basket, and reinforcement members between said plate and said stem.

3. A garbage bag holder as defined in claim 2 in which said means includes a receptacle into which said stem is inserted when said holder is to be used, pins extending inwardly in said receptacle, and slots in said stem for receiving said pins.

4. A garbage bag holder as defined in claim 1 in which said walls and said bottom of said basket contain numerous relatively small openings.

5. A garbage bag holder as defined in claim 3 in which said walls and said bottom of said basket contain numerous relatively small openings.

6. A garbage bag holder as defined in claim 1 in which said one wall has outwardly extending pins at the bottom thereof, channels are disposed under said bottom, and said pins slide in said channels as said one wall is moved under said basket when said basket is opened.

7. A garbage bag holder as defined in claim 6 in which said basket includes means for securing said one wall in a vertical, closed position.

8. A garbage bag holder as defined in claim 7 in which said means for securing said one wall includes hooks at the top of said one wall, and eyes to which said hooks are attached when said wall is closed.

* * * * *